US009290978B2

(12) United States Patent
Mizner

(10) Patent No.: US 9,290,978 B2
(45) Date of Patent: Mar. 22, 2016

(54) GATE CLOSER

(71) Applicant: Aaron M. Mizner, Tampa, FL (US)

(72) Inventor: Aaron M. Mizner, Tampa, FL (US)

(73) Assignee: NATIONWIDE INDUSTRIES, INC, Tampa, FL (US)

( * ) Notice: Subject to any disclaimer, the term of this patent is extended or adjusted under 35 U.S.C. 154(b) by 0 days.

(21) Appl. No.: 13/999,489

(22) Filed: Mar. 4, 2014

(65) Prior Publication Data

US 2015/0252606 A1 Sep. 10, 2015

(51) Int. Cl.

| | |
|---|---|
| ***E05F 1/00*** | (2006.01) |
| ***E05F 3/02*** | (2006.01) |
| *E05F 1/16* | (2006.01) |

(52) U.S. Cl.

CPC ... *E05F 3/02* (2013.01); *E05F 1/16* (2013.01); *E05Y 2800/21* (2013.01); *E05Y 2800/244* (2013.01); *E05Y 2900/40* (2013.01)

(58) Field of Classification Search

CPC ..... E05F 1/10; E05F 1/1041; E05F 1/105; E05F 3/22; E05F 3/00; E05F 3/02; E05F 1/16; E05F 11/00

USPC ..... 16/49, 66, 71, 80, 72; 49/325, 326

See application file for complete search history.

(56) References Cited

U.S. PATENT DOCUMENTS

| | | | | |
|---|---|---|---|---|
| 592,233 | A * | 10/1897 | Bowen | 16/67 |
| 2,071,660 | A * | 2/1937 | Schulz et al. | 16/66 |
| 2,153,833 | A * | 4/1939 | Hartshorn | 16/70 |
| 2,283,577 | A * | 5/1942 | Roby | 49/265 |
| 3,040,372 | A * | 6/1962 | Ellis | 16/62 |
| 3,861,080 | A * | 1/1975 | Schibli et al. | 49/31 |
| 4,322,912 | A * | 4/1982 | Heinrich | 49/28 |
| 4,417,418 | A * | 11/1983 | Warning | 49/199 |
| 4,773,125 | A * | 9/1988 | Watabe | 16/53 |
| 5,365,636 | A * | 11/1994 | Jensen | 16/67 |
| 5,622,007 | A * | 4/1997 | Archer | 49/404 |
| 6,871,381 | B1 * | 3/2005 | Luca | 16/52 |
| 8,356,386 | B2 * | 1/2013 | Liao | 16/71 |
| 2004/0261319 | A1 * | 12/2004 | Kennedy et al. | 49/339 |
| 2004/0266329 | A1 * | 12/2004 | Kennedy et al. | 454/169 |
| 2013/0219657 | A1 * | 8/2013 | Iwaki | 16/64 |

FOREIGN PATENT DOCUMENTS

| | | | |
|---|---|---|---|
| DE | 363328 | * | 11/1922 |
| DE | 102011052265 | A1 * | 5/2012 |
| GB | 524650 | * | 8/1940 |
| WO | WO 2012045601 | A1 * | 4/2012 |

* cited by examiner

*Primary Examiner* — Emily Morgan

(57) ABSTRACT

A dual actuator pneumatic gate closer coupled to a gate including a pair of pneumatic actuators each including a tube having a first and a second end together with a piston/rod combination movable between an extended and retracted position, a first and second coupling block affixed to the first end of each tube and each rod respectively, a spring movable between an expanded and compressed configuration disposed within each tube and a first and second actuator rod coupled between the gate and the first coupling block and a gate post and the second coupling block respectively such that when the gate is moved to an open position each actuator rod extends the corresponding rod compressing the corresponding spring and when the gate is released each spring expands retracting the corresponding rod extending the corresponding actuator rod closing the gate.

21 Claims, 9 Drawing Sheets

GATE CLOSER

BACKGROUND OF THE INVENTION

1. Field of the Invention

A dual pneumatic actuator gate or door closer.

2. Description of the Prior Art

Numerous gate and door closer designs have been developed over the years. These designs include pneumatic closers with pneumatic cylinder/piston arrangements.

Typically a cylinder is disposed in a chamber for compressed air to enter and a path for the air to leave and a piston with some type of action system. There are several different types of action systems for pneumatic cylinders each providing a slightly different kind of force. The first and most simple version is the single acting cylinder, where a piston oriented system forces compressed air through a solenoid valve into the back of the piston. This highly compressed air seeks the easiest way to exit and exerts a force on the piston face. As the piston is pushed out the air exits through escape valves positioned further down the cylinder. The piston falls back naturally in place until another burst of compressed air is fired into the cylinder.

The single acting cylinder can also be modified with a compressed spring mechanism, inserted between the end of the cylinder and the side of the piston opposite where the compressed air enters. This system works in a similar fashion but after the compressed air is released, the piston is forced back down to its original position at the end of the cylinder by the spring. This system is used for repeated linear motion involving heavy loads and requires a greater force of compressed air to complete cycle.

Pertinent examples of various designs are set forth below.

U.S. Pat. No. 369,203 and U.S. Pat. No. 1,190,563 disclose a door closer employing a single spring to return a door to the closed position after being extended or stretched by applying mechanical force to opposite ends thereof when opening the door.

U.S. Pat. No. 4,935,989 shows a door closer of the cylinder/piston type pivotably mounted to a door at a point adjacent the piston rod end of the cylinder. A leaf type spring may be added between the cylinder and the door. This configuration increases the closing force to the door as the door closes.

U.S. Pat. No. 5,471,708 describes a pneumatic door closer including an elongated cylinder with a bore extending axially thereof and end walls and a piston slidably reciprocable within the bore. A sealing ring of resiliently deformable material is disposed in a groove with greater diameter than the piston so as to project outwardly thereof. Since the axial dimension of the groove increases radially outwardly to a dimension greater than the diameter of the ring, the ring may move axially therewithin. When the piston moves toward the door closing position, the sealing ring bears against the diverging wall surface of the groove and the wall of the cylinder to restrict flow of air and when the piston moves towards the door opening position, the sealing ring bears against the generally radially extending wall surface of the groove to permit flow of air thereby.

U.S. Pat. No. 4,920,609 relates to a door closer comprising a housing, a plunger rod in the housing with a plunger at the inner end of the rod and a main spring disposed around the rod between the plunger and a housing end for urging the rod into the housing. With the door closer connected to a door, an actuator slides into a latch space when the door has been opened to hold the door open. A further opening movement raises the actuator out of the latch space and a sleeve maintains the actuator raised, permitting closing of the door.

U.S. Pat. No. 6,317,922 shows a door closer includes a cylinder and a piston sliding along the cylinder. The door closer has a speed adjustment knob extending from a first end for varying the closure rate. A door lock maintains the piston in an extended position and keeps the door open. The lock includes a washer sliding on the piston rod in a first position and locking the rod at a second position. The washer has a tab that engages an angled surface in the first position to prevent locking engagement with the piston rod. A rotatable end cap rotates the washer between the locked position and the unlocked position.

U.S. Pat. No. 8,051,534 relates to a pneumatic door closer comprising an elongated cylinder with a displaceable piston defining a vacuum chamber and a pressure chamber within the elongated cylinder wherein the piston is normally biased toward a door closing position by bias or spring. A piston rod connected to the piston has its free end extending through a rod opening that includes an air impervious seal formed about the piston rod extending therethrough. Disposed in communication with the vacuum chamber is a breather arrangement for diminishing in a controlled manner the level of vacuum being created within the vacuum chamber during the closing stroke of the piston to control the resulting resistance forces acting on the piston such that the closing speed is essentially uniform throughout the closing stroke.

Additional examples of the prior art are found in U.S. Pat. No. 1,286,664; U.S. Pat. No. 2,198,402 and U.S. Pat. No. 2,969,560.

While some of the prior art may contain some similarities relating to the present invention, none of them teach, suggest or include all of the advantages and unique features of the invention disclosed hereafter.

SUMMARY OF THE INVENTION

The present invention relates to a pneumatic gate/door closer coupled between a gate post or door jamb and a gate or door.

The pneumatic gate/door closer comprises a pair of tubes and a corresponding piston/rod combination at least partially disposed within the corresponding tube and movable between a retracted position when the gate/door is closed and an extended position when the gate/door is open.

A bias or compression spring movable between an expanded position or configuration when the gate/door is closed and a compressed position or configuration when the gate/door is open is disposed within each tube to move the gate/door from the open position to the closed position as described hereinafter.

The tubes are coupled together by a first coupling block or union; while, outer end portions of the rods are coupled together by a second coupling block or union. A first actuator rod is attached to the first coupling block or union and to the gate or door by a gate/door mount; while, a second actuator rod is attached to the second coupling block or union and to the gate post/door jamb by a post/jamb mount.

When installed, the bias or compression springs are expanded while the substantially parallel rods are retracted within the tubes. Upon opening the gate or door the actuator rods extend compressing the corresponding bias or compression spring 28.

When the open gate or door is released the bias or compression springs expand drawing the rods inwardly relative to the corresponding tube. Actuator rods slide in the alignment channel returning the gate or door to the closed position.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
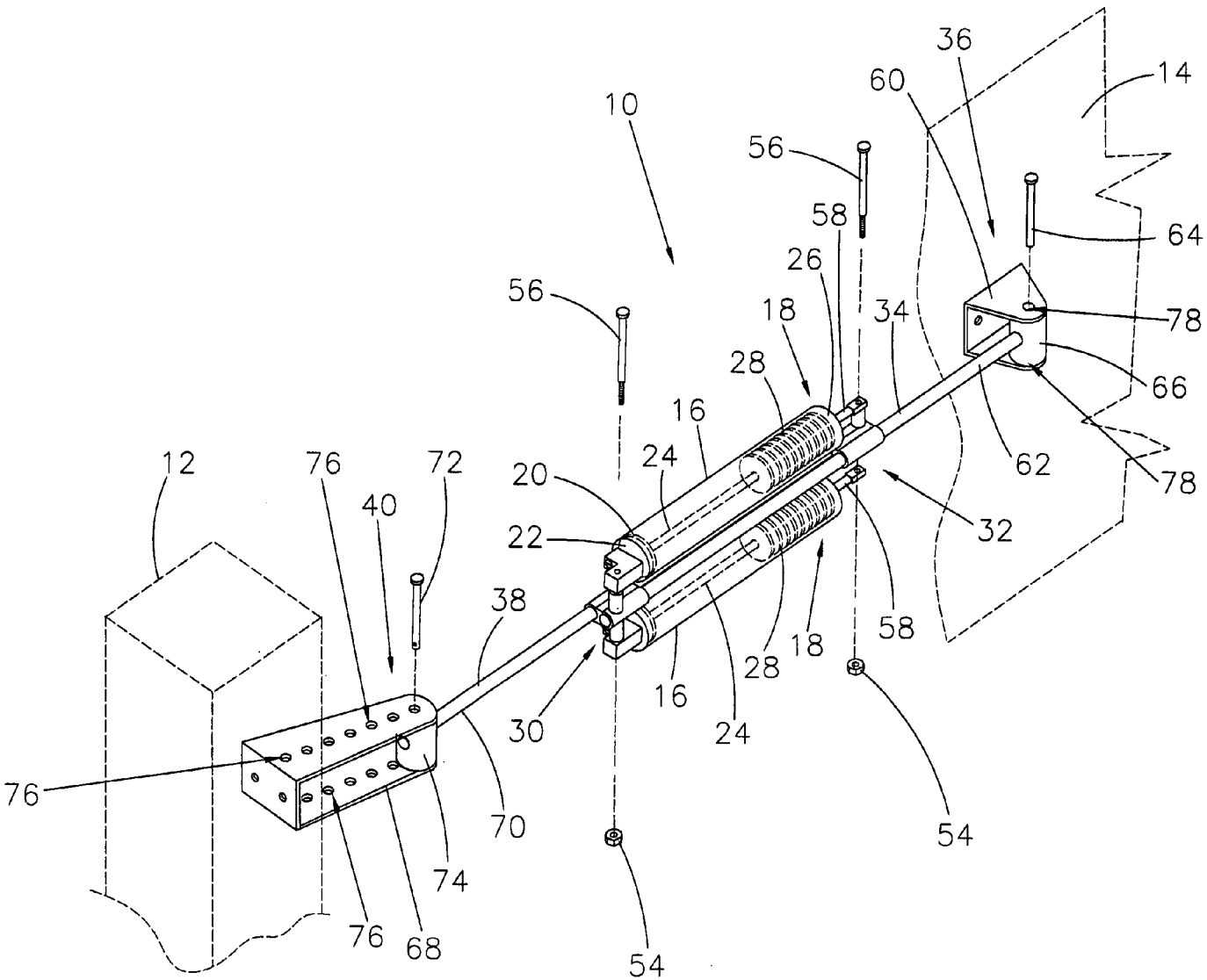
FIG. 1 is a perspective view of the dual actuator pneumatic gate/door closer of the present invention in the closed position.
Figure 2:
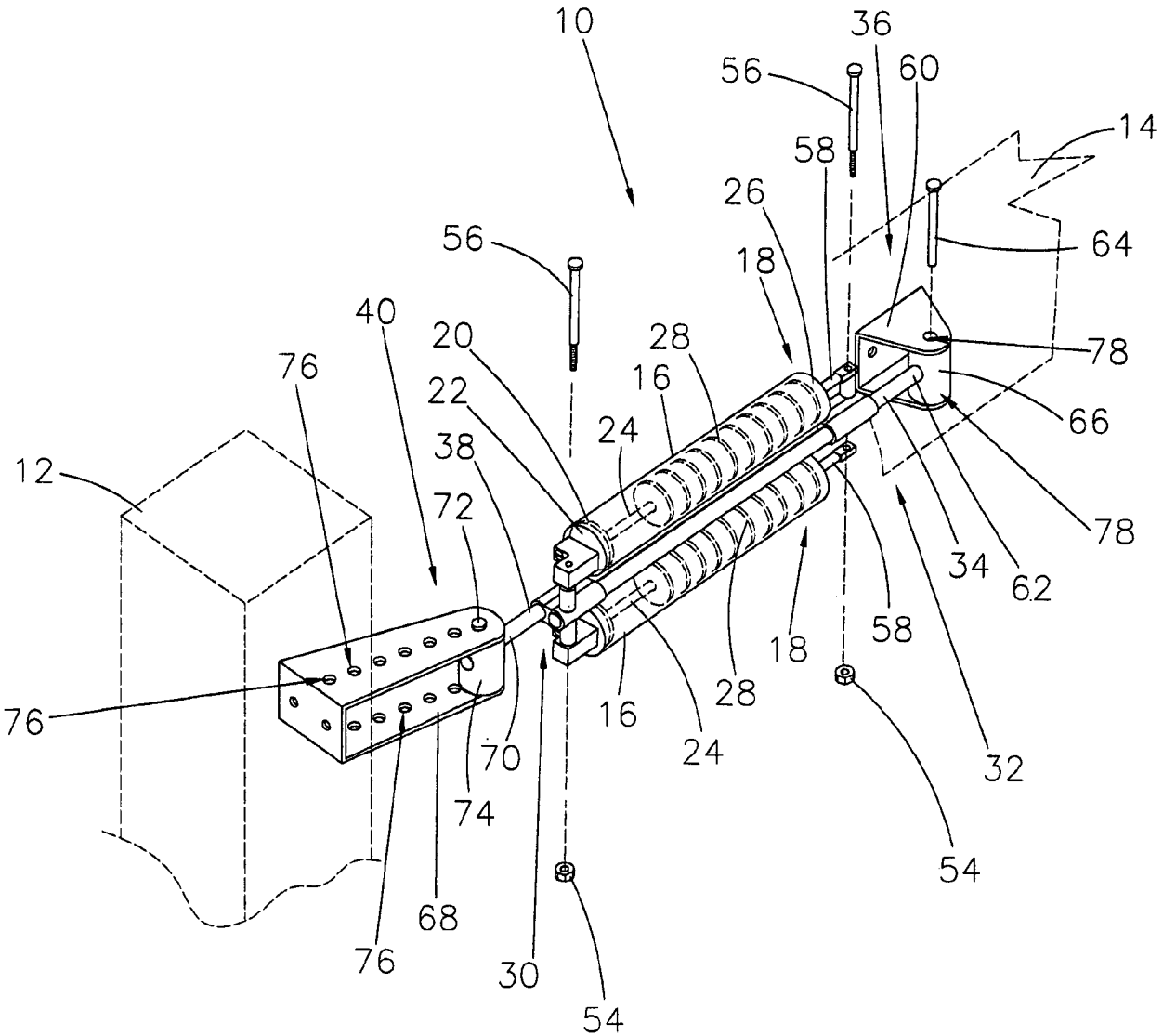
FIG. 2 is a perspective view of the dual actuator pneumatic gate/door closer of the present invention in the open position.
Figure 3:
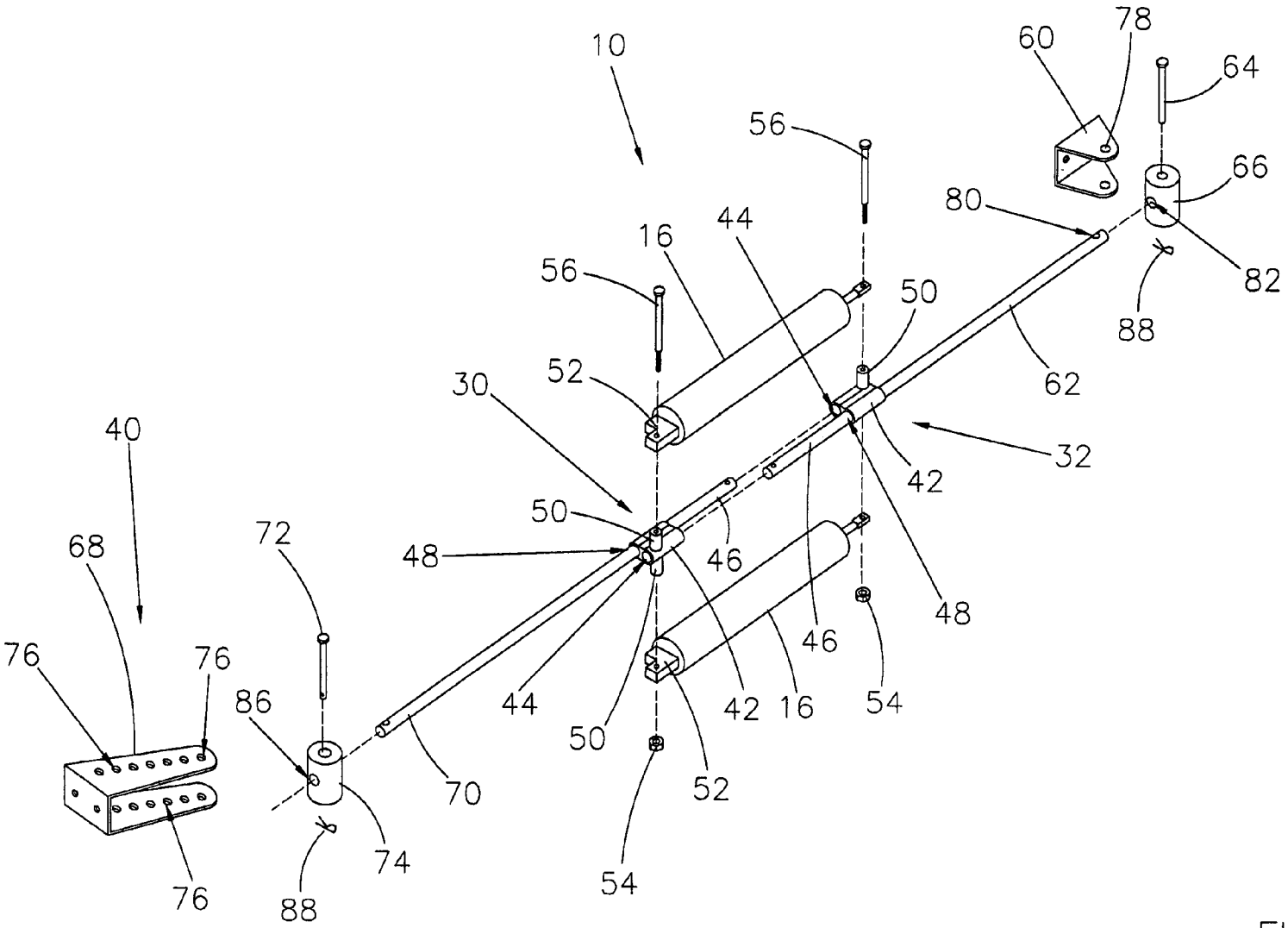
FIG. 3 is an exploded view of the dual actuator pneumatic gate/door closer of the present invention.

As shown in FIGS. 1 through 3, the present invention relates to a pneumatic gate/door closer generally indicated as 10 coupled between a gate post or door jamb 12 and a gate or door 14.

The pneumatic gate/door closer 10 comprises a pair of substantially parallel tubes each indicated as 16 and a corresponding piston/rod combination each generally indicated as 18 at least partially disposed within the corresponding tube 16 and movable between a retracted position (FIG. 1) when the gate/door 14 is closed and an extended position when the gate/door 14 is open (FIG. 2).

Each piston/rod combination 18 comprises a piston 20 disposed within the corresponding tube 16 toward the first end 22 thereof and a rod 24 attached to the piston 20 extending outwardly through an aperture (not shown) formed in the second end 26 of each tube 16.

A bias or compression spring 28 movable between an expanded position or configuration when the gate/door 14 is closed (FIG. 1) and a compressed position or configuration when the gate/door 14 is open (FIG. 2) is disposed within each tube 16 to move the gate/door 14 from the open position to the closed position as described hereinafter.

The substantially parallel tubes 16 are coupled at the first ends 22 thereof by a first coupling block or union generally indicated as 30; while, the outer end portions 58 of the substantially parallel rods 24 are coupled together by a second coupling block or union generally indicated as 32. A first actuator rod 34 is attached to the first coupling block or union 30 and to the gate or door 14 by a gate/door mount generally indicated as 36; while a second actuator rod 38 is attached to the second coupling block or union 32 and to the gate post/door jamb 12 by a post/jamb mount generally indicated as 40.

As best seen in FIG. 3, each coupling block or union 30/32 comprises a body 42 including a first channel or recess 44 to receive a first end portion 46 of each actuator rod 34/38 to affix the corresponding actuator rod 34/38 to the corresponding coupling block or union 30/32 and an aligned alignment channel 48 to slidingly receive the corresponding actuator rod 34/38 therethrough. Each coupling block or union 30/32 further includes an attachment member 50 formed on each side of the corresponding body 42. The attachment members 50 are attached to a corresponding attachment element 52 affixed to the first end 22 of corresponding tube 16 by a nut 54 and bolt 56 combination or other suitable fasteners and to the outer end portion 58 of each corresponding rod 24 by a nut 54 and bolt 56 combination on the suitable fasteners.

The gate/door mount 36 comprises a bracket 60 affixed to the gate or door 14, and pivotally coupled to the free end 62 or end opposite the first coupling block or union 30 of the first actuator rod 34 by a pin 64 and a hollow mounting member 66 to receive the pin 64 therethrough. The post/jamb mount 40 comprises a bracket 68 affixed to the gate post or door jamb 12 and pivotally coupled to the free end 70 or end opposite the second coupling block or union 32 by a pin 72 and a hollow or mounting member 74 to receive the pin 72 therethrough. A plurality of apertures separately indicated as 76 are formed in the bracket 68 to permit adjustment of the location and direction of the biasing force of the pneumatic gate/door closer 10.

The pneumatic gate/door closer 10 may further include a stop assembly to adjust the overall or effective length of the pneumatic gate/door closer 10 when the gate or door 14 is in the fully open position as shown in FIG. 2.

Figure 4:
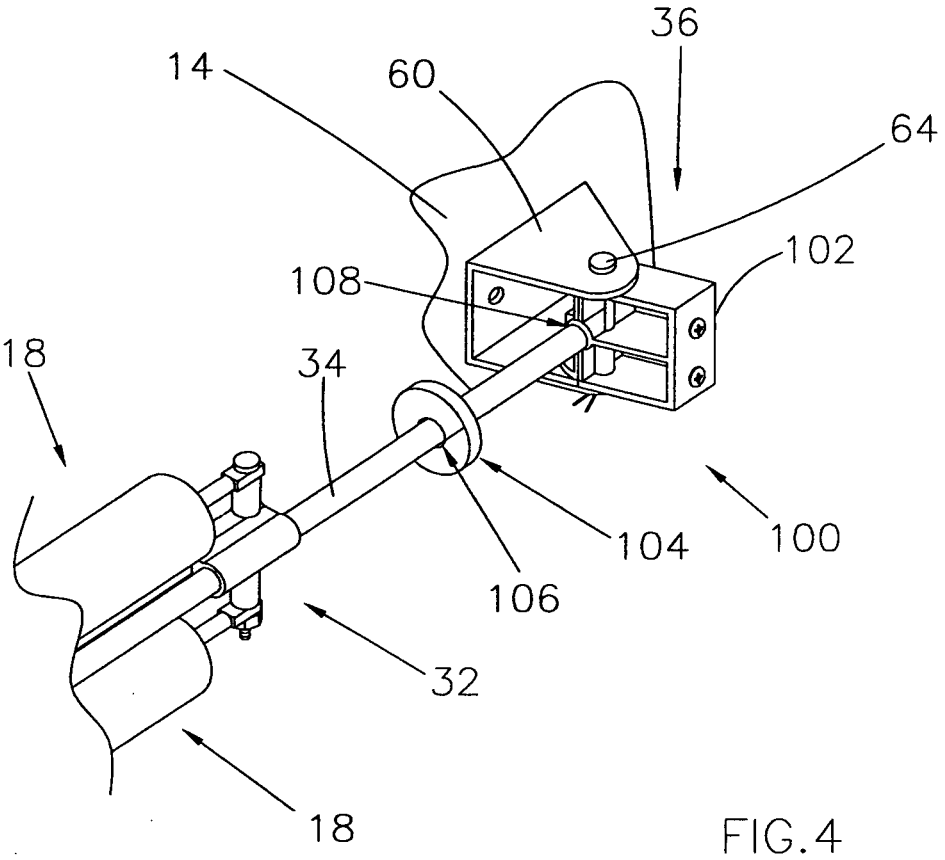
FIG. 4 is a perspective view of the stop assembly of the present invention when the gate or door is closed.

As shown in FIG. 4, the stop assembly generally indicated as 100 comprises a stop mount 102 coupled to the bracket 60 of the gate/door mount 36 and a shim or spacer 104 including an aperture or hole 106 to receive the first actuator rod 34 therethrough.

The outer end portion of the first actuator rod 34 is disposed within a recess or channel 108 formed in or through the stop mount 102.

Figure 5:
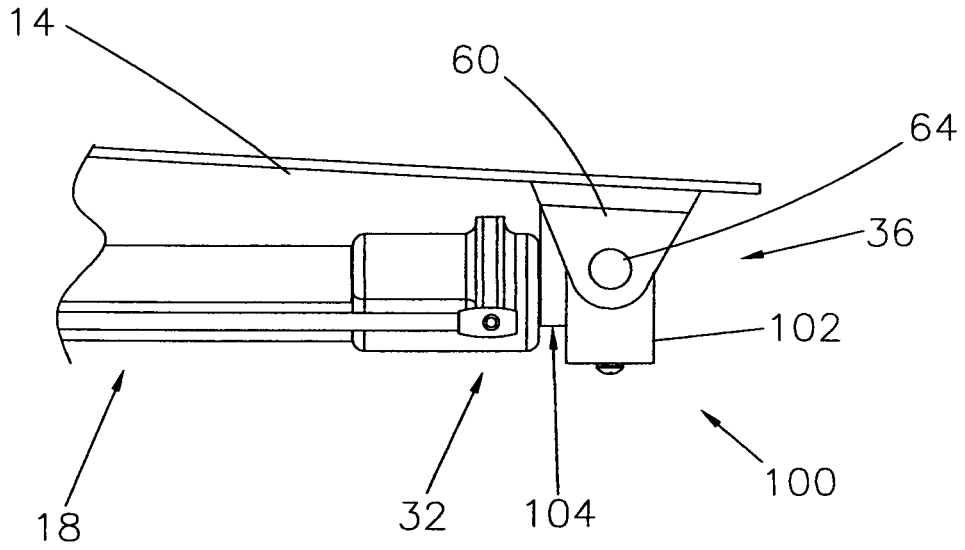
FIG. 5 is a top view of the stop assembly of the present invention when the gate or door is open.

As shown in FIG. 5, when the gate or door is fully open the shim or spacer 104 is sandwiched or pressed between the second coupling block or union 32 and the stop mount 102 thereby limiting or preventing the gate or door 14 from opening any further.

Figure 6:
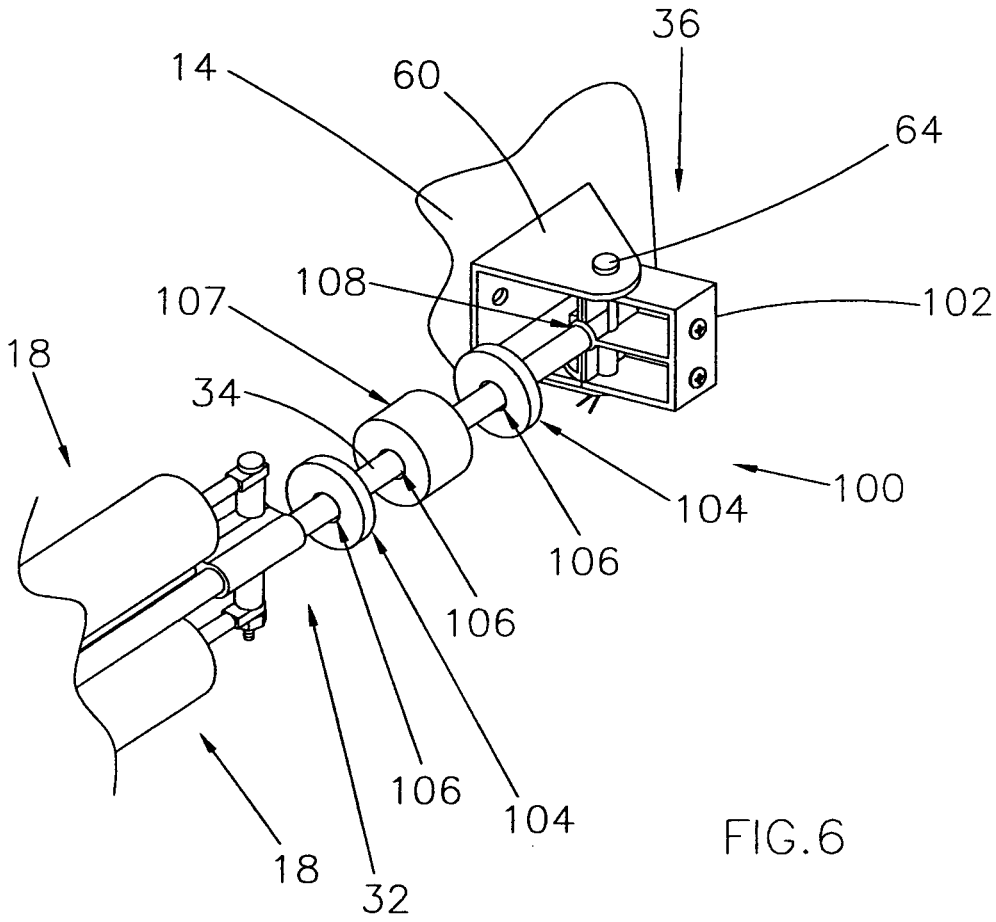
FIG. 6 is a perspective view of an alternate embodiment of a stop assembly of the present invention when the gate or door is closed.

FIG. 6 shows an alternate embodiment of the stop assembly 100. Specifically, the stop comprises a stop mount 102 coupled to the bracket 60 of the gate/door mount 36 and a pair of shims or spacers 104 each including an aperture or hole 106 to receive the first actuator rod 34 therethrough disposed on opposite sides or ends of a compressible element 107 such as a spring or resilient material including an aperture or hole 106 to receive the first actuator rod 34 therethrough.

The outer end portion of the first actuator rod 34 is disposed within a recess or channel 108 formed in or through the stop mount 102.

Figure 7:
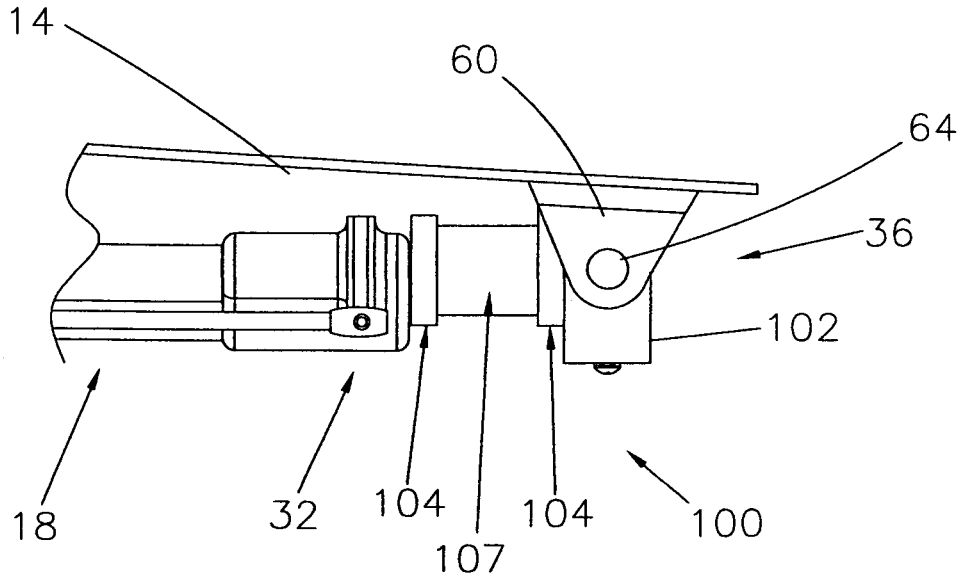
FIG. 7 is a top view of the alternate embodiment of the stop assembly of the present invention shown in FIG. 6 when the gate or door is open.

As shown in FIG. 7, when the gate or door is fully open the shims or spacers 104 and compressible element 107 are sandwiched or pressed between the second coupling block or union 32 and the stop mount 102 thereby limiting or preventing the gate or door 14 from opening any further.

Figure 8:
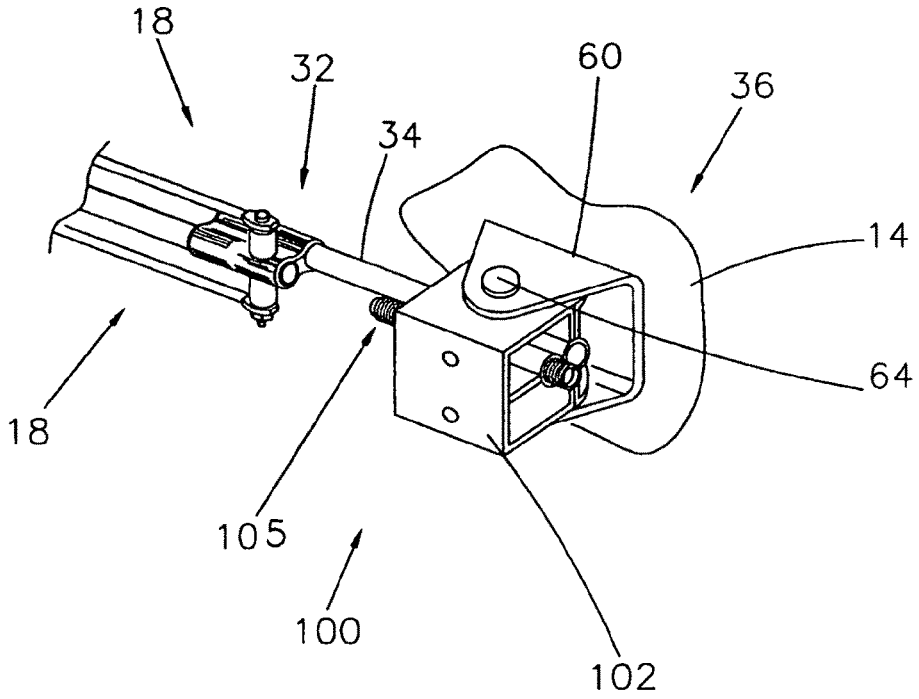
FIG. 8 is a perspective view of another alternate embodiment of a stop assembly of the present invention when the gate or door is closed.

FIG. 8 shows another alternate embodiment of the stop assembly 100. In particular, the stop assembly comprises a stop mount 102 coupled to the bracket 60 of the gate/door mount 36 and an adjustable stop member 105 comprising an externally threaded member threadably coupled to an internally threaded recess or channel 108 formed in or through the stop mount 108.

Figure 9:
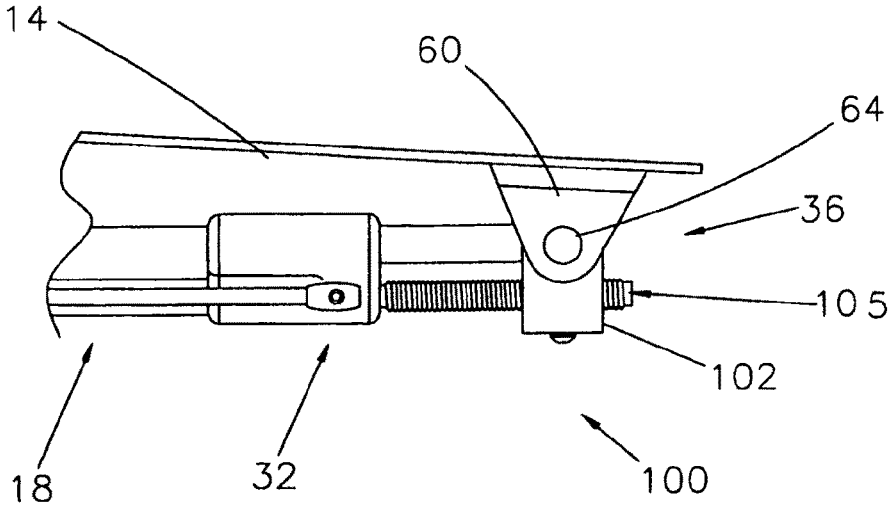
FIG. 9 is a top view of the alternate embodiment of the stop assembly shown in FIG. 8 when the gate or door is open.

As shown in FIG. 9, when the gate or door 14 is fully open the inner end portion of the adjustable stop member 105 engages the second coupling block or union 32 thereby limiting or preventing the gate or door 14 from opening any further. Since the adjustable stop member 105 is externally threaded and the recess or channel 108 is internally threaded, the position of the adjustable stop member may be adjusted relative to the stop mount 102 to control the open position of the gate or door 14.

Figure 10:
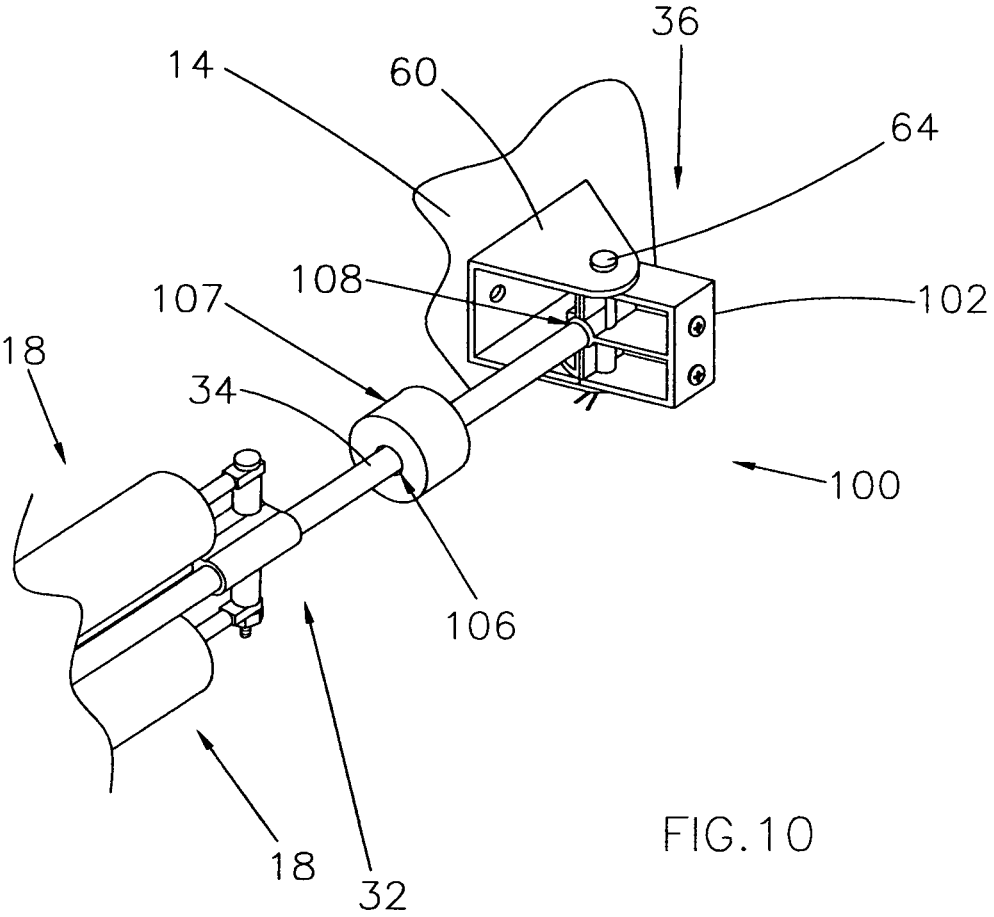
FIG. 10 is a perspective view of yet another alternate embodiment of a stop assembly of the present invention when the gate or door is closed.

FIG. 10 shows yet another alternate embodiment of the stop assembly 100. Specifically, the stop comprises a stop mount 102 coupled to the bracket 60 of the gate/door mount 36 and a compressible element 107 such as a spring or resilient material including an aperture or hole 106 to receive the first actuator rod 34 therethrough.

The outer end portion of the first actuator rod 34 is disposed within a recess or channel 108 formed in or through the stop mount 102.

Figure 11:
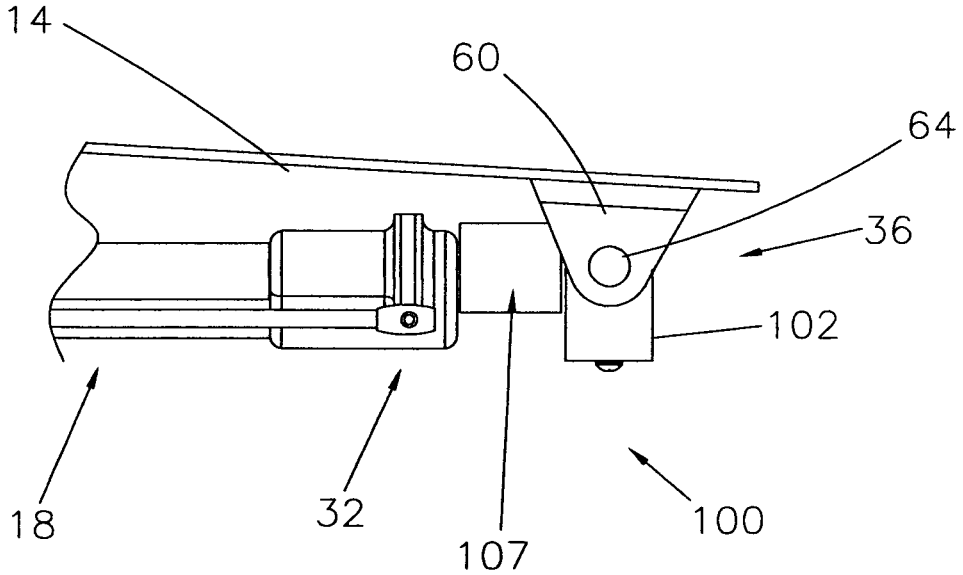
FIG. 11 is a top view of the alternate embodiment of a stop assembly shown in FIG. 10 when the gate or door is open.

As shown in FIG. 11, when the gate or door is fully open the compressible element 107 is sandwiched or pressed between the second coupling block or union 32 and the stop mount 102 thereby limiting or preventing the gate or door 14 from opening any further.

Figure 12:
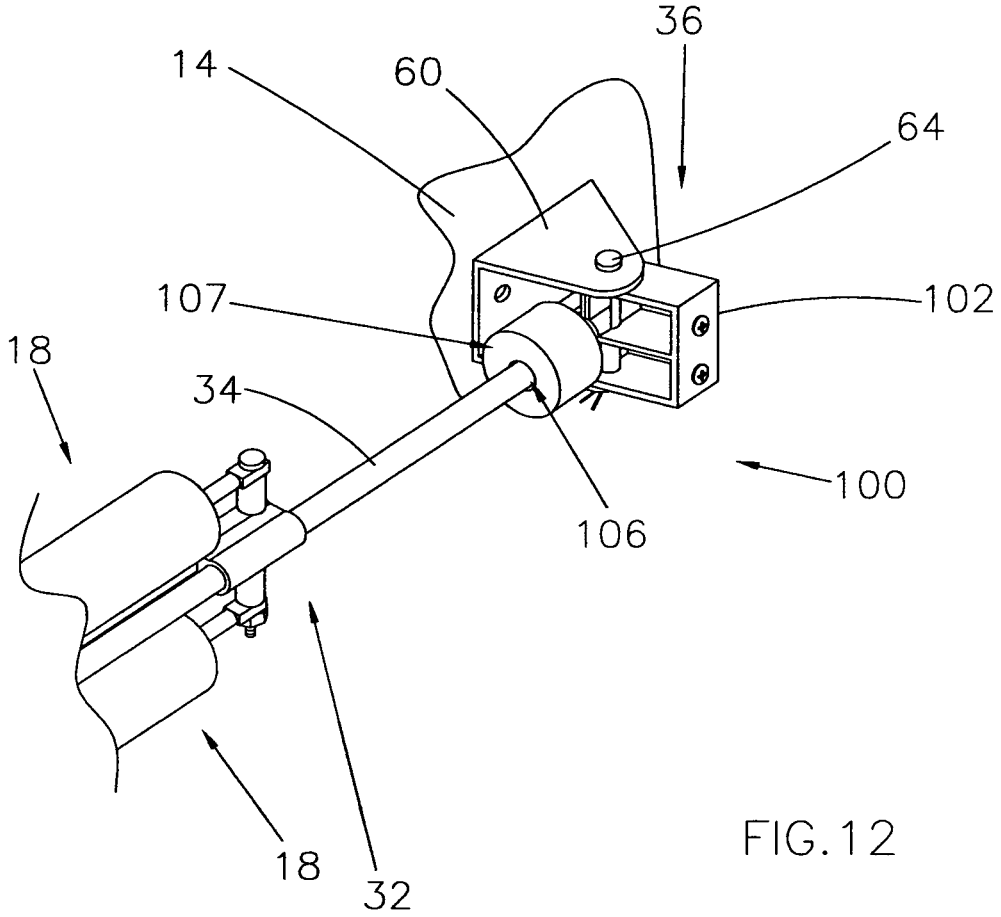
FIG. 12 is a perspective view of still another alternate embodiment of a stop assembly of the present invention when the gate or door is closed.

FIG. 12 shows an alternate embodiment of the stop assembly 100. Specifically, the stop comprises a stop mount 102 coupled to the bracket 60 of the gate/door mount 36 and a compressible element 107 such as a spring or resilient material including an aperture or hole 106 to receive the first actuator rod 34 therethrough attached to the stop mount 102.

The outer end portion of the first actuator rod 34 is disposed within a recess or channel 108 formed in or through the stop mount 102.

Figure 13:
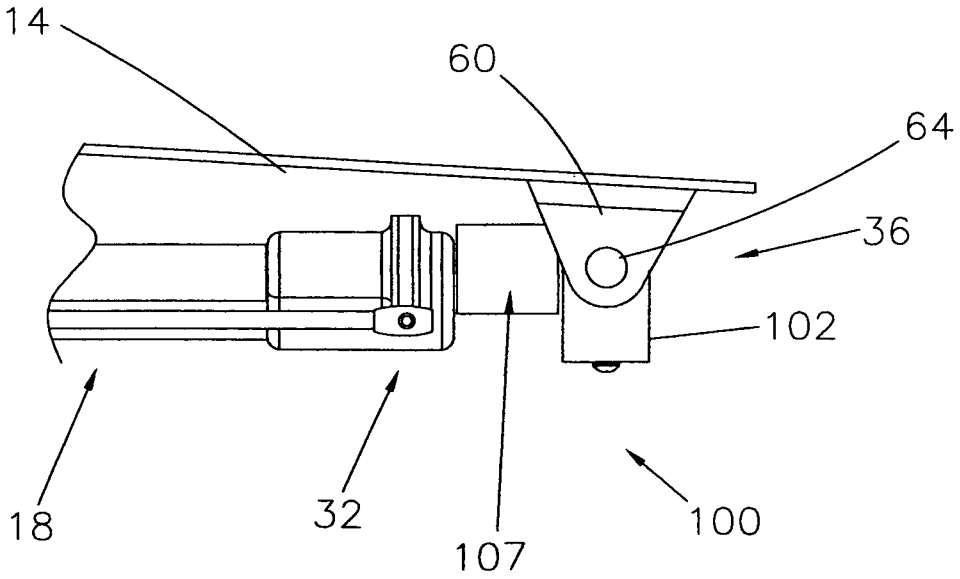
FIG. 13 is a top view of the alternate embodiment of a stop assembly shown in FIG. 12 when the gate or door is open.

As shown in FIG. 13, when the gate or door is fully open the compressible element 107 is sandwiched or pressed between the second coupling block or union 32 and the stop mount 102 thereby limiting or preventing the gate or door 14 from opening any further.

Figure 14:
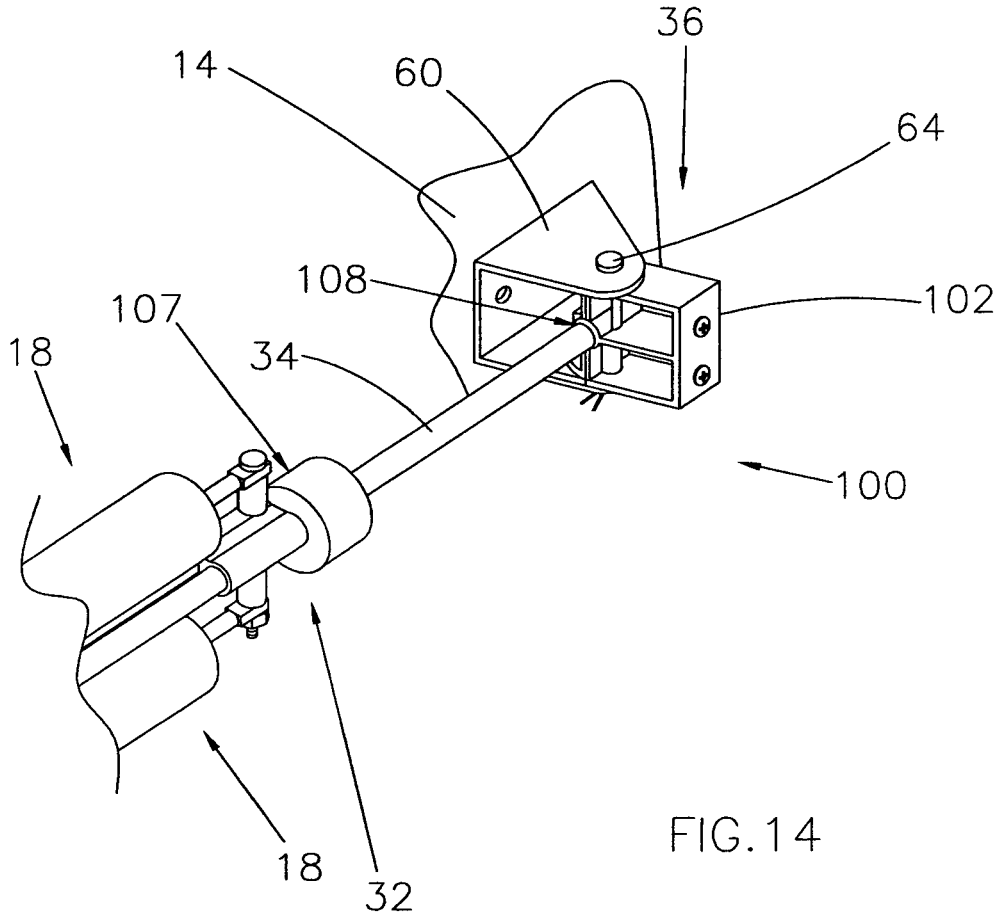
FIG. 14 is a perspective view of yet still another alternate embodiment of a stop assembly of the present invention when the gate or door is closed.

FIG. 14 shows an alternate embodiment of the stop assembly 100. Specifically, the stop comprises a stop mount 102 coupled to the bracket 60 of the gate/door mount 36 and a compressible element 107 such as a spring or resilient material including an aperture or hole 106 to receive the first actuator rod 34 therethrough attached to the second coupling block or union 32.

The outer end portion of the first actuator rod 34 is disposed within a recess or channel 108 formed in or through the stop mount 102.

Figure 15:
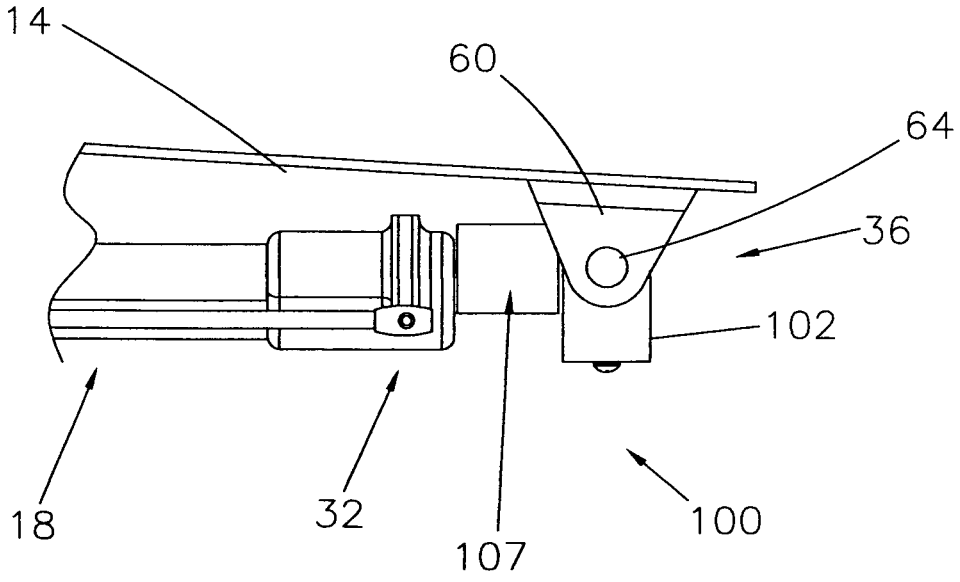
FIG. 15 is a top view of FIG. 14 of the alternate embodiment of a stop assembly of the present invention when the gate or door is open.

As shown in FIG. 15, when the gate or door is fully open the compressible element 107 is sandwiched or pressed between the second coupling block or union 32 and the stop mount 102 thereby limiting or preventing the gate or door 14 from opening any further.

To install the pneumatic gate/door closer 10, brackets 60 and 68 are affixed to the gate or door 14 and gate post or door jamb 12 respectively. The pneumatic gate/door closer 10 is then mounted to the gate/door 14 by passing pin 64 through apertures 78 formed in bracket 60, hollow mounting member 66 and a hole 80 formed through the end portion of the free end 62 of the first actuator rod 34 that extends through a hole 82 formed through or in the side of the hollow mounting member 66 and mounted to the gate post/door jamb 12 by passing pin 72 through corresponding apertures 76 formed on bracket 68, hollow mount member 74 and a hole 84 formed through the end portion of the free end 70 of the second actuator rod 38 that extends through a hole 86 formed through or in the side of the hollow mounting member 74. Pins 64 and 72 are secured to brackets 60 and 68 respectively by cotter pins 88 or similar securing devices.

When installed, the bias or compression springs 28 are expanded while the substantially parallel rods 24 are retracted as seen in FIG. 1. Upon opening the gate or door 14, the actuator rods 34 and 38 extend the corresponding rod 24 outwardly relative to the second end 26 of the corresponding tube 16 pulling or drawing the corresponding piston 20 toward the second end 26 of the corresponding tube 16 and compressing the corresponding bias or compression spring 28 as seen in FIG. 2. Sliding engagement of the actuator rods 34 and 38 within the alignment channels 48 of the second coupling block or union 32 and the first coupling block or union 30 respectively maintains the longitudinal alignment of the substantially parallel actuator rods 34 and 38 and substantially parallel rods 24 of the pneumatic gate/door closer 10 during the opening and closing of the gate or door 14.

When the open gate or door 14 is released the bias or compression springs 28 expand drawing each rod 24 into the corresponding tube 16 as the substantially parallel actuator rods 34 and 38 slide in the alignment channel 48 of the second coupling block or union 32 and the first coupling block or union 30 respectively returning the gate or door 14 to the closed position as shown in FIG. 1.

The air pressure within the substantially parallel tubes 16 between the corresponding front end 22 and corresponding piston 20 modulates the speed of the closing of the gate or door 14.

The tube and piston/rod combinations of the pneumatic gate/door closer 10 may comprise a device such as a SMART LION part #1107T-52 pneumatic closer or similar closer.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A dual actuator pneumatic gate closer and gate, said dual pneumatic gate closer comprising a pair of pneumatic actuators, each including:

a tube having a first end and a second end;

a piston/rod combination movable between an extended and retracted position;

a first coupling block affixed to said first end of each tube, including a recess and an alignment channel;

a second coupling block affixed to each piston/rod combination, including a recess and an alignment channel;

a bias disposed within each said tube, movable between an expanded configuration and compressed configuration;

a first actuator rod extending through the alignment channel of the second block, and coupled between the recess of the first coupling block at a first end, and the gate at a second end; and a second actuator rod extending through the alignment channel of the first block, and coupled between said recess of the second coupling block at a first end, and a gate post at a second end; wherein the gate closer is configured such that when the gate is moved to an open position, each said bias is compressed, and when the gate is released, each said bias expands to close the gate.

2. The dual actuator pneumatic gate closer of claim 1 wherein each said piston/rod combination comprises a piston disposed within said corresponding tube toward said first end thereof and a rod including an outer end attached to said piston extending outwardly through an aperture formed in said second end of each said tube.

3. The dual actuator pneumatic gate closer of claim 2 wherein said bias comprises a compression spring disposed within said each tube movable between said expanded configuration when the gate is closed and said compressed configuration when the gate is open to move the gate from the open position to the closed position.

4. The dual actuator pneumatic gate closer of claim 2 wherein said tubes are substantially parallel relative to each other coupled at said first ends thereof by said first coupling block and said rods are substantially parallel relative to each other coupled together by said second coupling block at said second ends thereof.

5. The dual actuator pneumatic gate closer of claim 1 wherein each said coupling block further includes an attachment member formed on each side of the corresponding body.

6. The dual actuator pneumatic gate closer of claim 5 wherein each said attachment member is attached to a corresponding attachment element affixed to said first end of corresponding tube by a fastener and to said outer end portion of each corresponding rod.

7. The dual actuator pneumatic gate closer of claim 1 wherein said gate mount comprises a bracket affixed to the gate and pivotally coupled to said first coupling block of said first actuator rod and said post mount comprises a bracket affixed to the gate post and pivotally coupled to said second coupling block.

8. The dual actuator pneumatic gate closer of claim 1 further including a stop assembly to adjust the overall or effective length of the pneumatic gate closer when the gate is in the fully open position.

9. The dual actuator pneumatic gate closer of claim 8 wherein said stop assembly comprises a stop mount coupled to the bracket of the gate mount and a shim including an aperture to receive said first actuator rod therethrough such that when the gate is fully open said shim is pressed between said second coupling block and said stop mount thereby limiting the gate from opening further.

10. The dual actuator pneumatic gate closer of claim 9 wherein said outer end portion of said first actuator rod is disposed within a recess formed in said stop mount.

11. The dual actuator pneumatic gate closer of claim 8 wherein said stop assembly comprises a stop mount coupled to the bracket of the gate mount and a pair of shims each including an aperture to receive said first actuator rod therethrough disposed on opposite sides of a compressible element including an aperture to receive said first actuator rod therethrough such as when the gate is fully open the shims and compressible element are pressed between said second coupling block and said stop mount thereby limiting the gate from opening further.

12. The dual actuator pneumatic gate closer of claim 11 wherein said outer end portion of said first actuator rod is disposed within a recess formed in said stop mount.

13. The dual actuator pneumatic gate closer of claim 8 wherein said stop assembly comprises a stop mount coupled to the bracket of the gate mount and an adjustable stop member coupled to a recess formed in said stop mount such that when the gate is fully open the inner end portion of said adjustable stop member engages said second coupling block thereby limiting the gate from opening further.

14. The dual actuator pneumatic gate closer of claim 13 wherein said adjustable stop member is externally threaded and said recess is internally threaded such that the position of said adjustable stop member may be adjusted relative to said stop mount to control the open position of the gate.

15. The dual actuator pneumatic gate closer of claim 8 wherein said stop assembly comprises a stop mount coupled to the bracket of the gate mount and a compressible element including an aperture to receive said first actuator rod therethrough such as when the gate is fully open said compressible element is pressed between said second coupling block and said stop mount thereby limiting the gate from opening further.

16. The dual actuator pneumatic gate closer of claim 15 wherein said outer end portion of said first actuator rod is disposed within a recess formed in said stop mount.

17. The dual actuator pneumatic gate closer of claim 8 wherein said stop assembly comprises a stop mount coupled to the bracket of the gate mount and a compressible element including an aperture to receive said first actuator rod therethrough attached to said stop mount such as when the gate is fully open said compressible element is pressed between said second coupling block and said stop mount thereby limiting the gate from opening further.

18. The dual actuator pneumatic gate closer of claim 17 wherein said outer end portion of said first actuator rod is disposed within a recess formed in said stop mount.

19. The dual actuator pneumatic gate closer of claim 8 wherein said stop assembly comprises a stop mount coupled to the bracket of the gate mount and a compressible element including an aperture to receive said first actuator rod therethrough attached to said second coupling block such as when the gate is fully open said compressible element is pressed between said second coupling block and said stop mount thereby limiting the gate from opening further.

20. The dual actuator pneumatic gate closer of claim 19 wherein said outer end portion of said first actuator rod is disposed within a recess formed in said stop mount.

21. The dual actuator pneumatic gate closer of claim 8 wherein said stop assembly comprises a stop mount coupled to the bracket of the gate mount and at least one shim including an aperture to receive said first actuator rod therethrough disposed on one side of a compressible element including an aperture to receive said first actuator rod therethrough such as when the gate is fully open the shim and compressible element are pressed between said second coupling block and said stop mount thereby limiting the gate from opening further.

* * * * *